US007243446B2

(12) United States Patent
Vindriis

(10) Patent No.: US 7,243,446 B2
(45) Date of Patent: Jul. 17, 2007

(54) METHOD FOR PROVIDING AN INSOLE FOR FOOTWEAR FOR INCREASED SENSORY STIMULATION AND AN INSOLE SUITED FOR THE METHOD

(76) Inventor: Søren Vindriis, Tulipanparken 43, Horsens (DK) 8700

( * ) Notice: Subject to any disclaimer, the term of this patent is extended or adjusted under 35 U.S.C. 154(b) by 306 days.

(21) Appl. No.: 10/504,509

(22) PCT Filed: Feb. 13, 2003

(86) PCT No.: PCT/DK03/00094

§ 371 (c)(1),
(2), (4) Date: Aug. 13, 2004

(87) PCT Pub. No.: WO03/068015

PCT Pub. Date: Aug. 21, 2003

(65) Prior Publication Data

US 2005/0252039 A1 Nov. 17, 2005

(30) Foreign Application Priority Data

Feb. 13, 2002 (DK) ..... PA 2002 00214

(51) Int. Cl.
*A43B 13/18* (2006.01)

(52) U.S. Cl. ..... 36/141; 36/43; 36/29; 36/3 B

(58) Field of Classification Search ..... 36/141, 36/43, 44, 29, 88, 3 R, 3 B
See application file for complete search history.

(56) References Cited

U.S. PATENT DOCUMENTS

| | | | | |
|---|---|---|---|---|
| 4,694,831 | A * | 9/1987 | Seltzer | 36/141 |
| 5,287,638 | A * | 2/1994 | Preston | 36/28 |
| 5,400,526 | A * | 3/1995 | Sessa | 36/3 B |
| 5,664,342 | A * | 9/1997 | Buchsenschuss | 36/43 |
| 5,669,162 | A | 9/1997 | Dyer | |
| 5,771,606 | A * | 6/1998 | Litchfield et al. | 36/29 |
| 5,894,687 | A * | 4/1999 | Lin | 36/141 |
| 6,119,370 | A * | 9/2000 | Baron | 36/29 |
| 6,505,420 | B1 * | 1/2003 | Litchfield et al. | 36/29 |
| 6,745,499 | B2 * | 6/2004 | Christensen et al. | 36/29 |
| 2003/0101619 | A1 * | 6/2003 | Litchfield et al. | 36/29 |
| 2004/0098882 | A1 * | 5/2004 | Tuan | 36/29 |

FOREIGN PATENT DOCUMENTS

| | | |
|---|---|---|
| WO | WO 97/03583 | 2/1997 |
| WO | WO 01/08523 | 2/2001 |

* cited by examiner

*Primary Examiner*—Marie Patterson
(74) *Attorney, Agent, or Firm*—James Creighton Wray

(57) ABSTRACT

A method for providing an insole and an insole for footwear for increased sensory stimulation of a foot in the footwear. The method comprises preselecting positions on the foot with nerves at these positions to be stimulated and providing means for stimulating elevation of said insole at said preselected positions during step movement of said foot on said insole.

19 Claims, 8 Drawing Sheets

Figure 1:
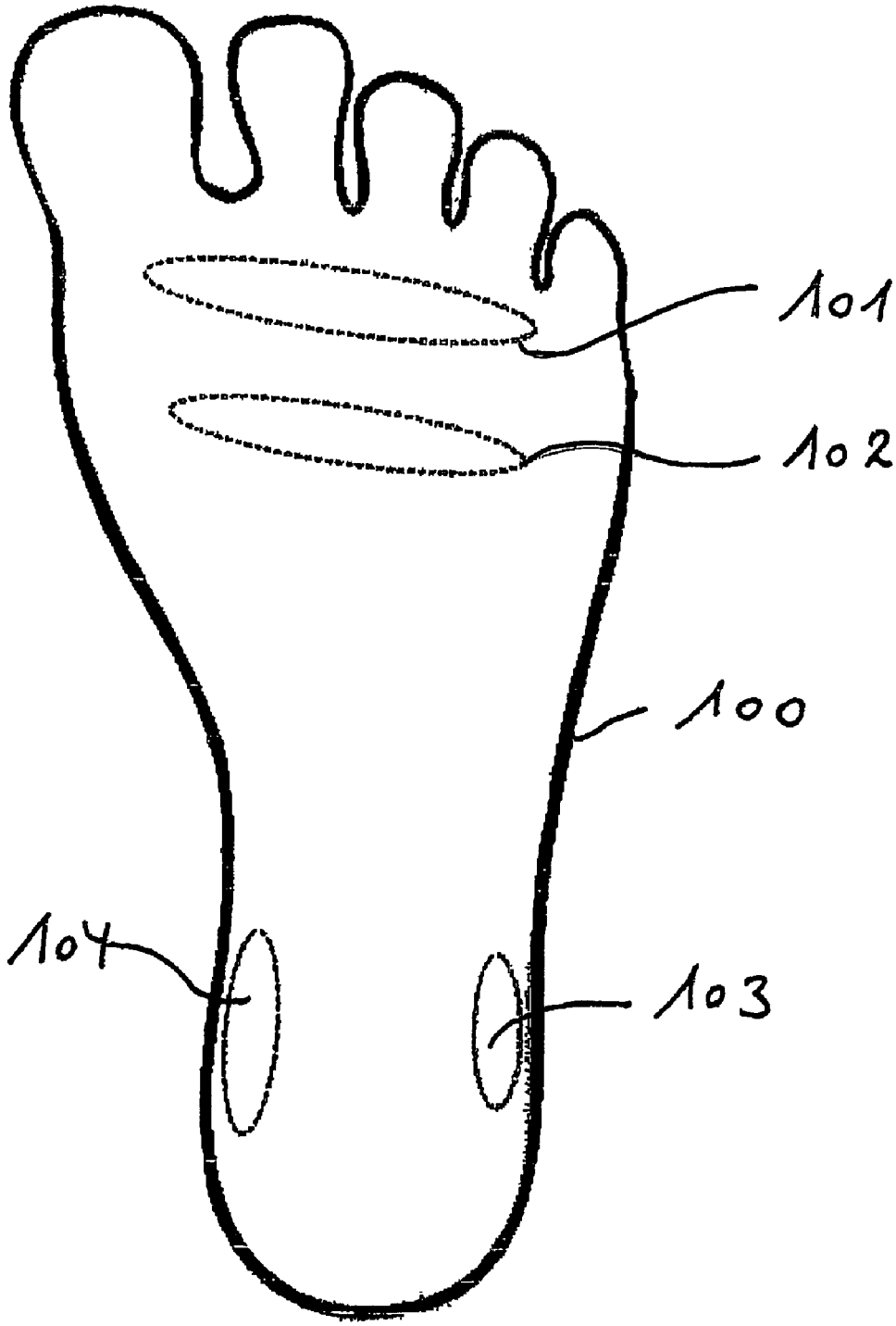

200
201
202
203
204
205
206
207
208
209
210
L 406
404
406
403
401'
405
301
401
402
A
304'
403
401'
303'
401
402
A

304'''
303'''

409
401''
304''
303''

FIG. 5c
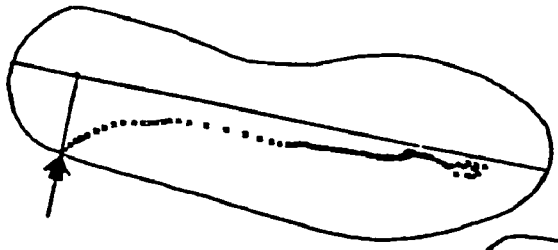
FIG. 5a
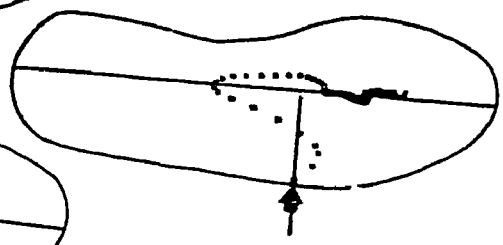
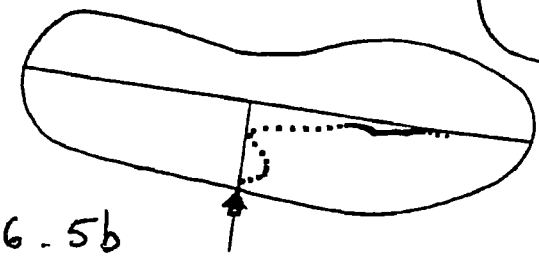
FIG. 5b 204
203
300
703''
300
703'
300
704
703
300
401
701
703
704
704
705

METHOD FOR PROVIDING AN INSOLE FOR FOOTWEAR FOR INCREASED SENSORY STIMULATION AND AN INSOLE SUITED FOR THE METHOD

This application claims the benefit of Danish Application No. 2002 00214 filed Feb. 13, 2002 and PCT/DK03/00094 filed Feb. 13, 2003.

FIELD OF THE INVENTION

The present invention relates to a method for providing an insole for footwear for increased sensory stimulation of a foot in the footwear and an insole suited for this method.

BACKGROUND OF THE INVENTION

A large number of insoles of different kinds are commercially available for different purposes, such as cushioning to increase the comfort, support of the foot during walking or sports activities, damping of shock during sports activities and for massaging effects.

Especially for the damping of shocks and for a massaging effect, fluid filled insoles are well-known, for example from International patent applications WO 97/03583, WO 00/24283, WO 01/08523, and WO 02/28216 by Vindriis.

Though a number of different aspects have generally been addressed in the improvement of insoles, still needs exist for improvements of insoles, especially in connection with sports shoes as a steady better performance of athletes is highly demanded.

DESCRIPTION/SUMMARY OF THE INVENTION

By studying the performance of feet during walking and running, it has been observed in connection with the invention that certain stimulations of the sensoric nerves in the foot may lead to a changed foot movement and lead to a better balance. The reason for this is an increase in the strength and variation of the information signals communicated from the foot to the nerve system and the brain. A better balance during standing, walking and running is a key to better sports performance. A changed foot movement may, for example, result in a better walking ability of spastically enabled persons, and a faster foot movement for athletics. The causality will be explained in more detail in the following in connection with the invention.

In dependence on whether a person is walking or running, the foot is placed on the ground in different ways. For example, during walking, the person may start the setting of the foot on the ground by placing the heel, or he may place the whole foot on the ground. During running, the setting of the foot may start with the heel, but it may also be that the setting starts with the outer side of the foot or the bale of the foot, which furthermore depends on the running style of the person and the running speed. The style is dependent on the physiology of the legs and feet, but is also highly dependent on the balance that is communicated to the nerve system and the brain. Changing the running style of a person is normally a difficult task, as the reflex nerve system is used to a certain amount of information and reacts in response to that.

According to the invention, improvements for, among others, athletic sportswear can be achieved by a method for providing an insole for footwear for increased sensory stimulation of a foot in the footwear, wherein the method comprises preselecting positions on the foot with nerves at these positions to be stimulated and providing dynamic means for stimulating elevations of said insole at said preselected positions during movement, for example step movement, of said foot on said insole.

Dynamic means for stimulating elevations may be provided by dynamic elevations or by static elevations with an underlying fluid chamber which in a dynamical way changes the height of the static elevations.

Static elevations stimulate the nerves of the foot at the area of the elevation in dependence of the weight of the foot on the elevations even in a still standing position. The primary purpose of static elevations is adjustments of the motion of the foot. As has turned out during studies in connection with the invention, a much higher stimulation can be obtained, if an insole with static elevations is combined with a fluid chamber, such that the stimulation properties of the static elevations are dynamically enhanced by the flow of the fluid in the fluid chamber during foot movement. The enhancement is also present in case that the person using the insole tries to stand still. Due to the resiliency of the fluid chamber, where fluid can flow from one region under the foot to another region under the foot, the foot will perform minute movements and experience a larger stimulation than with an insole where static elevations are provided but without an underlying fluid chamber. This may be beneficial for humans that are training the foot movements when standing and walking. Such training may be used after accidents with damage to the nerve system and for training partially disabled people. In addition, due to the underlying fluid chamber, a training of balance is achieved.

For example, such static elevations may be provided on the insole at preselected positions of the foot, for example where the sensoric nerves provide information that the foot has to be moved from the ground for the next step. In case that the runner starts the setting of the foot by placing the heel on the ground and rolling thereafter over the bale of the foot, the nerves in the bale region may be additionally stimulated by the static elevations of the insole which result in an earlier retraction of the foot from the ground. According to the invention, this effect is enhanced by the use of an underlying fluid chamber containing a fluid, the fluid chamber extending from a first region under said foot to a second region under said foot, the second region extending under the foot to said preselected positions, the first region being configured to be subject to suppression under load from the foot for transport of fluid from said first region to said second region during load from said foot on said first region. For example, the fluid chamber extends under the whole foot. In this case, the placement of the foot on the heel region will displace fluid from the heel region to the front region of the fluid chamber with a lifting of the static elevations, such that an even earlier stimulation occurs than without the fluid chamber.

Dynamic elevations are elevations that are created in the insole during the motion of the foot on the insole. This kind of elevations primarily increases the balance of the foot motion, because these elevations stimulates nerves in a larger area of the foot and, therefore, increases the amount of information from the foot to the nerve system and the brain. Furthermore, the dynamic support of the foot has an increased positive influence on the blood circulation in the foot.

Both kinds of elevations increase in a dynamical way the stimulation of nerves during movement of the foot in order to increase the performance of the foot by improving the balance and optimising the foot movement. By the method according to the invention, new ways for improvements of sports performances are provided.

According to the invention, dynamic elevations may be provided by a method according to the invention comprising providing an insole with an elastic fluid chamber containing a fluid, for example a liquid or a gel, the fluid chamber extending from a first region under the foot to a second region under the foot, the second region extending under the foot to the preselected positions for stimulation, the first region being configured to be subject to suppression under load from the foot for transport of fluid from the first region to the second region during load from the foot on the first region. The method further comprises determining a pattern of obstructions in the fluid chamber and providing the obstructions in the fluid chamber, the pattern being provided according to predetermined criteria, wherein the predetermined criteria comprises flow of fluid from the first region to the second region during load from the foot on the first region with a promoted increment of height of the insole at the preselected positions for providing dynamic local stimulating elevations.

Dynamic elevations are dependent on the motion of the foot and on the speed of the motion. For example, the insole according to the invention with a fluid chamber may be provided with an obstruction pattern that allows a relatively large amount of liquid to be displaced during slow motion of the foot which results in high elevations at the nerve stimulation areas, while only a relatively small amount of liquid is removed during fast motion of the foot. Thus, the highest degree of stimulation is achieved during slow motion. During running, this speed dependent stimulation will result in stimulation towards faster running. Such a kind of insole is beneficial for runners in competitions, as a slightly faster running may be the essential difference for winning the competition.

In order to provide an insole according of the invention in an optimum way, the method implies determining the walking profile or running profile of a person. In this way, areas to be stimulated may be determined. During the provision of the obstructions, criteria are used including flow speed and flow direction.

An insole according to the invention may be produced in a way as described in the aforementioned International patent applications WO 97/03583, WO 00/24283, WO 01/08523, and WO 02/28216 by Vindriis. Thus, the fluid chamber may be provided by joining two foils joined together along an edge area. Obstructions inside these fluid chambers may be provided by additional joints between the two foils, preferably made by welding. In addition, such additional joints may be provided with different heights for promoting presence of fluid near the higher joints. A way to achieve this, for example by using welding with various welding pressure, is described in International patent applications WO 02/28216 by Vindriis.

Dynamic and static elevations may be provided at the same areas of the foot. However, it is also possible to provide dynamic elevations at some preselected positions of the foot and provide static elevations at further preselected positions on the foot. In this way, an insole may be provided which functions differently whether the person in the insole is standing, walling or running.

In order to provide dynamic elevations during jogging, for example, the first fluid chamber may extend from the heel of the foot to the bale. When the jogger is setting the foot on the ground, this is often done by starting with the heel. This start with displace the fluid from the heel to the front part of the foot, where certain obstructions in the fluid chamber promotes the liquid to be displaced to certain areas under the bale of the foot, increasing the balance due to nerve stimulations. As the liquid is displaced from the heel, the shock damping may occur not to be as pronounced as desired. Therefore, according to the method according to the invention, there is further provided a second fluid chamber located only under the heel of the foot. Such an additional chamber may provide additional shock absorption. Alternatively, the second fluid chamber may be located only under the bale of the foot, which would be appropriate for running on the forefoot. Apart from providing shock absorption, such a second fluid chamber also provides a three dimensional support of the heel under standing conditions or during walking, because the fluid chamber is deformed in a way to embrace the heel with the result of a larger contact area between the heel and the support under the heel.

Apart from the method as described above, the invention foresees an insole suited for a method as described above. This insole comprising a fluid chamber with fluid between two foils joined along an edge area, wherein the insole comprises means for elevation of the insole at preselected positions under the foot during step movement of the foot on the insole for nerve stimulation.

The means comprises a pattern of additional joints in the fluid chamber between the two foils, wherein the pattern is constructed according to predetermined criteria to promote the flow of fluid from a first region to a second region of the fluid chamber during load from the foot on the first region with an increment of height of the fluid chamber at the preselected positions of the foot for providing dynamic elevations for nerve stimulation.

As described above, the insole may comprise a further fluid chamber under only the heel part of the foot or only under the bale of the foot.

In a further embodiment, the fluid chamber of the insole is provided with a net structure on the upper side for lateral transport of moisture. Such a net is disclosed in International patent application WO 01/08523 by Vindriis.

Advantageously, the two foils of the fluid chamber of the insole or the further fluid chamber or both of them may be provided with fabrics having a tensile strength higher than the tensile strength of the foils, the fabrics being at least partly enclosed in the polymer material of the foils in order to increase the tensile strength of the foil in combination with the fabric for counteracting creep of the foil. Such combination of fabrics implemented in such foils, for example by partly melting the fabrics into the foils is disclosed in International patent application WO 00/03583 by Vindriis.

A practical embodiment for provision of static as well as dynamic elevations may be achieved with an insole with a first, upper part made of polymer foam comprising static elevations at preselected positions of the foot for nerve stimulation during step movement of the foot on the insole and a second, lower part comprising the fluid chamber between two polymer foils. In order to be able to change the upper or lower part of the insole, the second part may be constructed to be detachable from the first part.

In order to remove moisture from the foot, the first, upper part made of foam may be provided with a perforation for transport of moisture.

As has been found out, the method and insoles according to the invention are not only very helpful for ameliorating sports performances but also the standing, walking and running performances of disabled people, for example after accidents or spastically disabled persons.

SHORT DESCRIPTION OF THE DRAWINGS

Figure 6B:
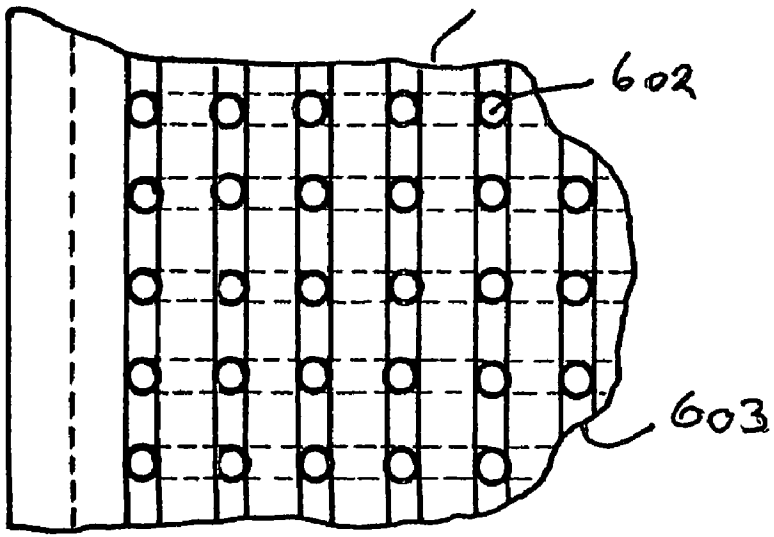
Figure 6A:
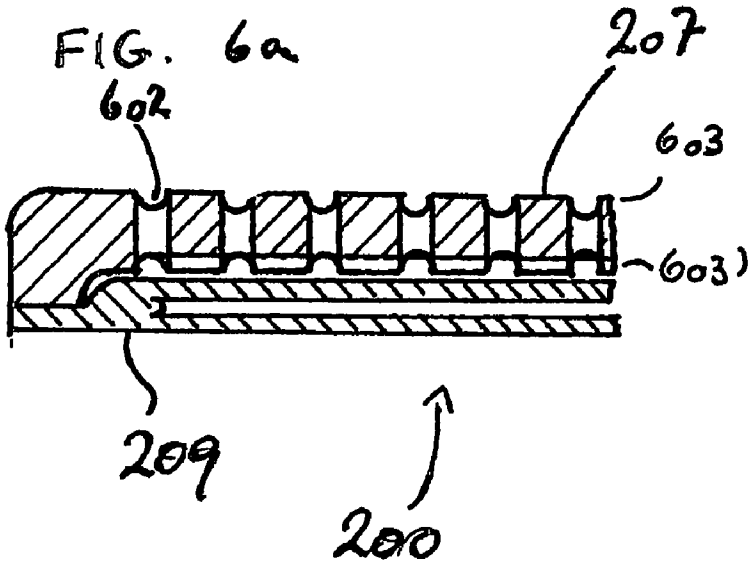

The invention will be explained in more detail with reference to the drawing, where FIG. 1 shows the lower side of a foot with indications of areas for stimulation, FIG. 2 show an insole with static elevations on an insole according to the invention suitable for the method according to the invention, FIG. 3 shows an insole with a fluid chamber and illustrates the functioning, FIG. 4 shows different patterns for an insole according to the invention, FIG. 5 illustrates running profiles, FIG. 6 shows a combined insole with static elevations and a fluid chamber for dynamic elevations, FIG. 7 shows an insole with a combination of a first and a second fluid chamber, FIG. 8 shows an embodiment of the second fluid chamber.

DETAILED DESCRIPTION/PREFERRED EMBODIMENT

FIG. 1 shows the lower side of a foot 100. Different areas on the foot may be stimulated for achieving certain effects. It has turned out that especially the regions, where tendons are fastened to the bones have a high number of nerves used for finding correct motion.

For example, the region in front of the heel and the sides of the foot 103, 104 are especially suited for stimulation of the directional feeling of the foot. The areas on both sides 101, 102 of the bones of the forefoot may be stimulated for a better roll-off of the foot. In order to improve the feeling for balance, it is important to cover an area as large as possible by dynamic pressure stimulation of the foot. In this connection, it is important that the sole of the foot is subject to stimulation of a large area on the inner side and outer side of the foot 104, 103.

A new performance for the roll-off of the foot requires a change in the balance of the body. Therefore, in order to obtain optimum results in a change of foot movement, it is of high advantage that a stimulation of the balance is taken into account, where the latter is achieved by sensoric pressure activation. Even in cases where a change of foot movement is not desired, dynamic sensoric elevations improves the feeling for balance and the foot movement will be improved.

Figures 2A, 2B, 2C:
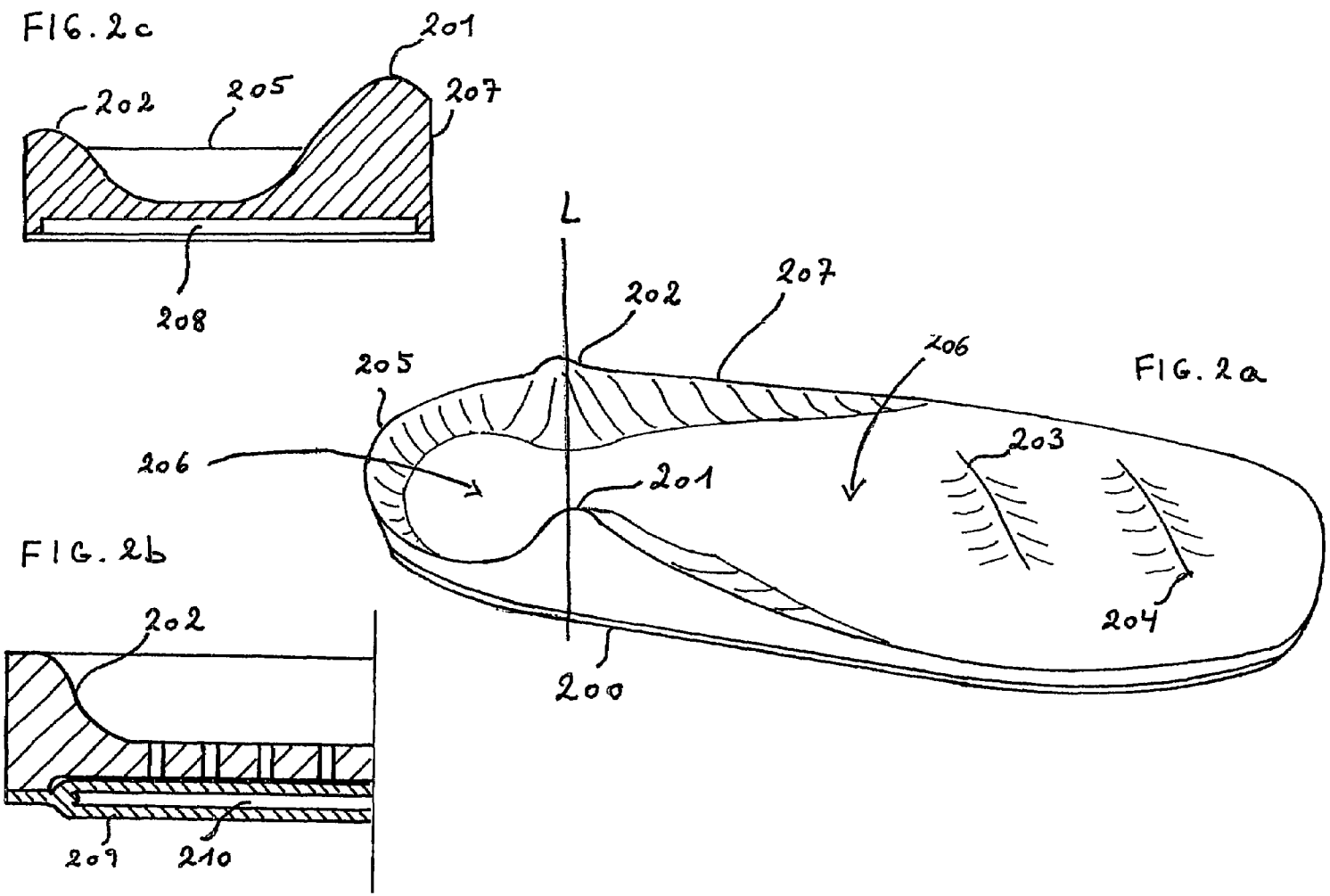

FIG. 2 is an insole 200 according to the invention, where FIG. 2*a* is a perspective view and FIG. 2*b* a cross sectional view along the indicated line. FIG. 2*c* is a part of a cross sectional view of a further embodiment.

The insole 200 is provided with static elevations 201, 202, 203 and 204 at those positions, where nerve stimulation is desired. For example, elevation 201 stimulates nerves in an area right of the left heel on the inner side of the foot. As a large part of the sensoric nerves on that side of the heel are situated higher than on the outer side of the heel, the static elevation 201 on the inner side of the heel is higher than the static elevation 202 at the outer side of the heel as illustrated in FIG. 2.

Such stimulation is of advantage for changes in the direction of the foot to the right or left relatively to the movement of the body and for changes of the angle of the foot with the shin. Such stimulation is also especially suited in the orthopaedic field. Elevations 203 and 204 are situated, where tendons are fastened to the bones of the forefoot. Also these areas on the foot have an increased number of nerve centres such that stimulation of these areas increases drastically the information flow from these nerve centres to the nerve system and the brain with a respective increased speed of the retraction of the foot with a potential for athletic improvement and speed. Support 205 along the heel is designed in accordance with the geometry of the heel such that supporting elevations 201, 202 are maintained in their geometry relative to the foot.

An insole of the above type may be produced from a flexible material, for example expanded polyurethane or Ethyl-vinyl-acetate. Such a material allows moulding into the desired form, but may as well be machined, for example by cutting, drilling or milling. In connection with the invention, the latter is of high interest, as the milling may be performed by a computer-controlled milling machine, where the computer may be programmed in accordance with the desired form for static elevations for the stimulation of the preselected areas of the foot. This method allows a quick adaptation to the foot in question of an insole according to the invention As illustrated in FIG. 2*b*, the insole 200 is a combination of static elevations 202 in the upper part of the insole 200 and a lower part 209 with a fluid chamber 210, where the lower part 209 is attached to the upper part by other means, for example by gluing. In the regions 206 without elevations, the upper part 200 may be produced thin, for example with a thickness of 1 mm, such that the influence from the underlying fluid chamber 210 is communication to the surface of the upper part of the insole 200.

Having such a combination of static elevations 201, 202, 203, 204, and a fluid chamber 210, it is possible to provide an insole 200 that stimulates nerves with a certain stimulation strength and at certain areas of the foot when standing, whereas a much higher stimulation strength is achieved when walking or running. Depending on the design and the running technique, the stimulation may be higher for certain areas than other areas. When the insole 200 is used for walking or jogging, the pressure from the heel of the foot when placed on the insole displaces the fluid from the first region at the heel area to the second region, for example at the bale of the foot. The static elevations 203 and 204 may thus have an increased effect due to the additional dynamic elevation from the underlying fluid chamber.

In order to transport moisture from the upper part 207 of the insole 200, the upper part 207, as illustrated in FIG. 2*b* and in more detail in FIG. 2*c*, may be provided with holes 602 and communicating channels 603 on the upper side of the upper part 207 and channels 603' on the lower side of the upper part 207.

Figure 3A:
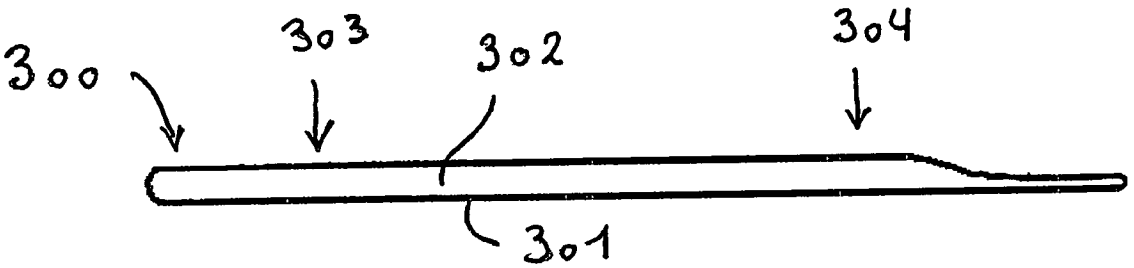

Dynamic elevations may be achieved with an insole as shown in FIG. 3*a*. The insole 300 has an elastic fluid chamber 301 containing a fluid 302. The fluid chamber 301 is extending from a first region 303 under the foot, for example the heel 305, to a second region 304 under the foot, for example the bale 306. The second region 304 extends to the preselected positions under the foot 100 as for example illustrated in FIG. 1 with positions 101 or 102. The first region 303 is configured to be subject to suppression under load from the heel 305 of the foot, which is illustrated in the left side of FIG. 3*b*, for transport of fluid from the first region 303 to the second region 304 during load from the foot on the first region 303.

Figure 3B:
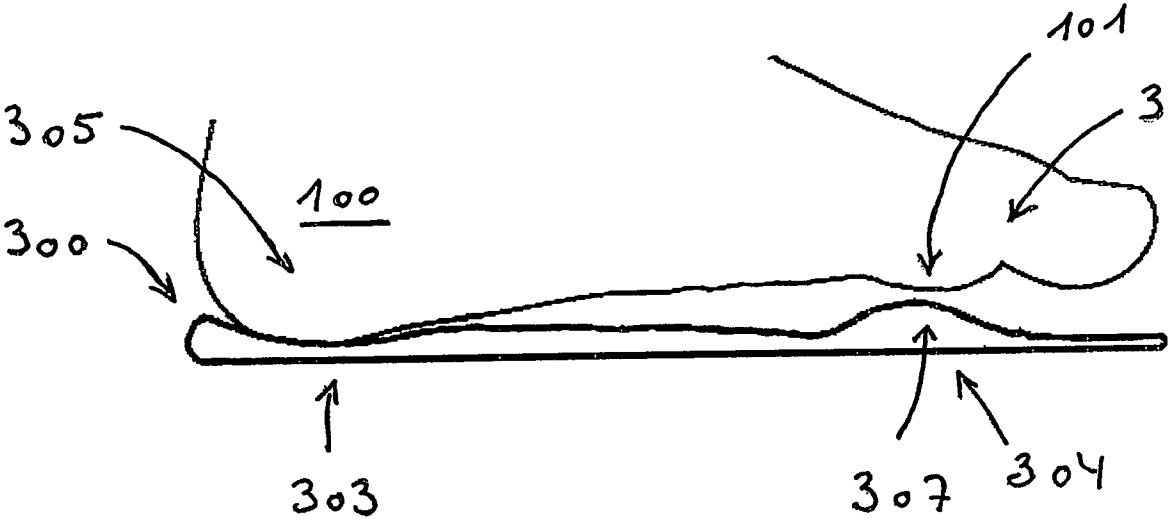

FIG. 3*b* illustrates a snapshot of a dynamic situation, where the heel 305 of the foot 100 during running has been placed on the insole, whereas the rolling movement of the foot has not yet resulted in a setting of the bale 306 of the foot 100 on the insole 300. The pressing of the heel 305 has resulted in a displacement of the liquid from the first region 303 to the second region 304, where a dynamic elevation 307 has evolved at an area 101 for stimulation of the foot 100. When the foot 100 is continuing the rolling movement after the shown snapshot situation, the bale 306 of the foot 100 will touch the insole 300 with the bale at en earlier stage than if no elevation 307 had been present. The early stimulation of the nerves at the area 101 in the foot 100 results in a faster rolling movement of the foot 100 resulting in a faster running.

Likewise, the insole 300 may be constructed with other dynamic elevation at other areas of the foot 100 to be stimulated. Dynamic elevations can be constructed by providing certain patterns of obstructions in the insole 300. Obstructions are generally known, for example as disclosed in International patent application WO 02/28216 by Vindriis, where the obstructions as joints between the upper and lower layers of the fluid chamber can be provided with different heights in order to achieve a certain flow profile of the fluid in the insole 300 under load with the foot 100. Such obstructions can advantageously be obtained by welding of the upper and lower layer of the fluid chamber. A desired flow profile may in addition be constructed by changing the extend of the welding points, for example the diameter, or by changing the mutual distance as shown in FIG. 4*c*.

It should be noted that insoles of the type as shown in FIG. 3 and FIG. 4 may be produced with a height of only 1.5-3 mm, which implies that such insoles fit into most existing footwear.

Figures 4A, 4B, 4C, 4D:
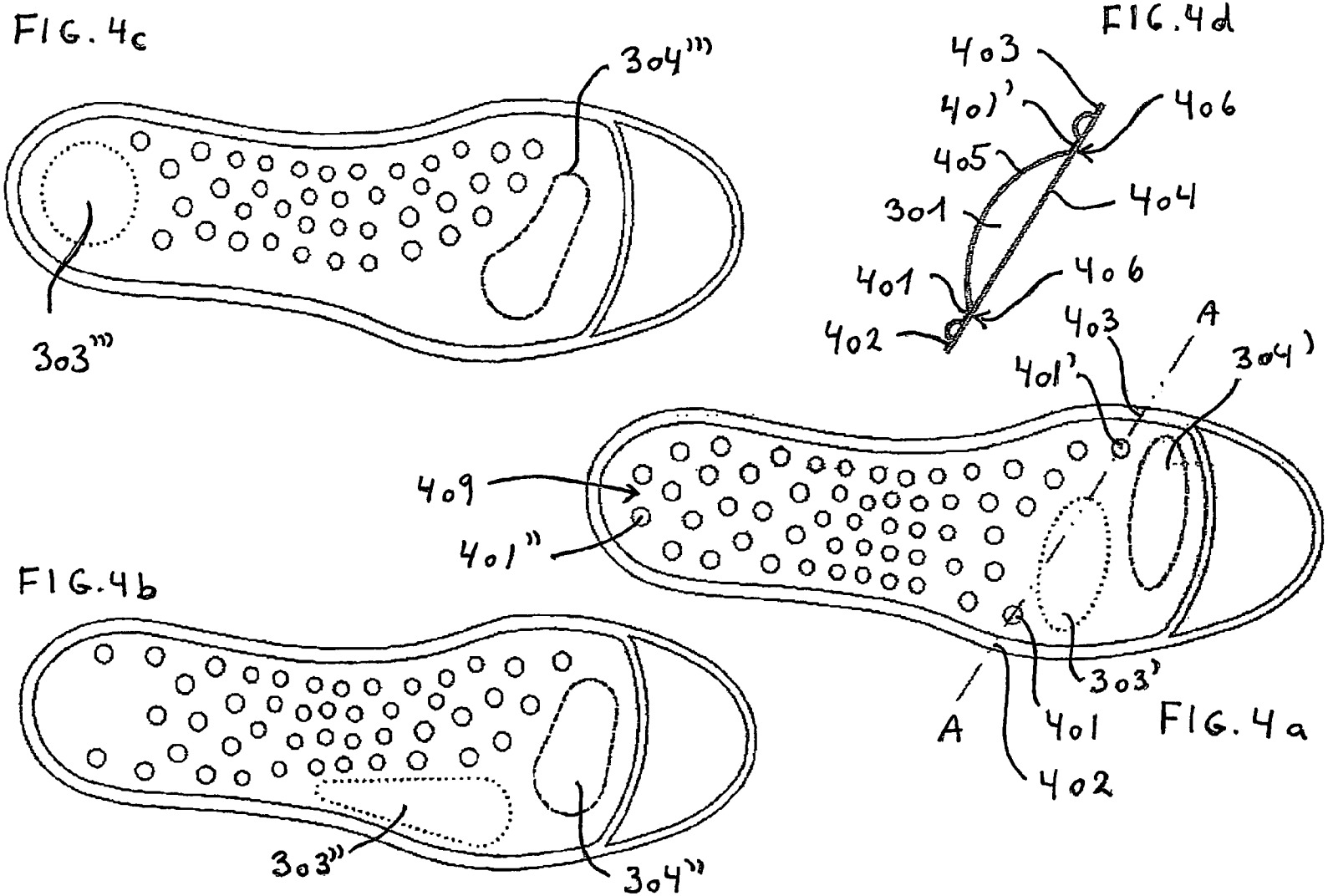

How a pattern may appear is illustrated in FIG. 4 showing three different patterns of obstructions 401, 401', 401". Such obstructions 401, 401', 401" can advantageously be obtained by high frequency welding of the upper layer 405 to the lower layer 404 of the fluid chamber 301 at welding joints 406, as illustrated in FIG. 4*d* being a cross section A-A of FIG. 4*a*, however not to scale. These joints 406 are shown as being point-like, which however is not necessary as also other welding shapes are possible as illustrated in the abovementioned International patent application WO 02/28216 by Vindriis and as used for joining the upper layer 405 and the lower layer 404 by welding 403, 402 along the edge region.

The pattern of FIG. 4*a* promotes the presence of liquid near the front part of the foot. The pattern of FIG. 4*b* promotes the presence of liquid in the right front part of the foot and at the heel with the possibility of displacement of a substantial amount of liquid from the heel to the right part of the bale of the foot. The patters of FIG. 4*c* promotes the presence of liquid at the front part, the right part and the heel of the foot 100, leaving various possibilities of fluid displacement from one region to another.

Such patterns may be determined for use by a variety of people in accordance with statistical models for usual walking or running behaviour, for example such that different patterns are used in dependence of whether the application is for jogging, sprinting or other sports performances. Furthermore, such patterns may, for example, also be constructed in accordance with the individual running performance of an athlete.

In order to adjust the flowing properties according to predetermined criteria, materials for the upper foil 405 and the lower foil 404 may be chosen with suitable elasticity and thickness. Furthermore, the amount of liquid in the fluid chamber and the viscosity of the fluid can be varied within a large interval. Thus, a broad spectrum of parameters is usable for insoles according to the invention with an adaptation to the actual needs in accordance with the predetermined criteria as response speed, time dependent stimulation during foot movement, strength of stimulation and shock damping properties including area of damping and efficiency of damping. A soft support has a more cushioning effect being more pleasant when walking, whereas a hard support may react quicker and be more suitable for athletic use.

How different running styles may influence the pattern to be used is illustrated further with reference to FIG. 5, where three different running profiles are illustrated. In FIG. 5*a*, a profile is shown, where the setting of the foot starts at the front side part of the foot and rolls over the central part and thereafter over the central front part, which is typical for sprinting. In FIG. 5*b*, the step starts by placing the right part of the foot on the ground with a roll towards the centre, before the foot is rolled over the front part. In FIG. 5*c*, a situation is shown, where the runner places the heel of the foot on the ground first after which the foot is rolled over the central part of the bale of the foot, which is typical for jogging or walking.

In the running profile of FIG. 5*a*, a heel setting is not used. Therefore, displacement of fluid will not occur from the heel region but from the side of the front part of the foot. In insole for improvement of the running performance may therefore be constructed as shown on FIG. 4*a*, where the liquid is displaced from the first region 303' to a second region 304'. For this reason, the heel area 409 is provided with welding 401", which result in a small distance between the upper 405 and lower foil 404 such than the heel region does not function as a reservoir for the liquid before, during or after suppression by the foot. However, the region with the pattern of welding 401, 401', 401 " may act as a shock absorber.

In the running profile of FIG. 5*b*, the foot is placed on the right side of the foot, such that a displacement of the fluid in the insole may start from this first region 303" to a second region 304" as illustrated in FIG. 4*b*.

In the running profile of FIG. 5*c*, the foot is placed on the heel, why the displacement of fluid may start there, as illustrated with the pattern in FIG. 4*c* for displacement from the first region 303'" to the second region 304'".

It should be acknowledged that the patterns as shown in FIG. 4 and their functions are more complex than just described as also the running profiles from FIG. 5 are more complex than described. The foregoing description is merely used for simple illustration and not limiting for the invention in any way.

Figures 7A, 7B, 7C, 7D:
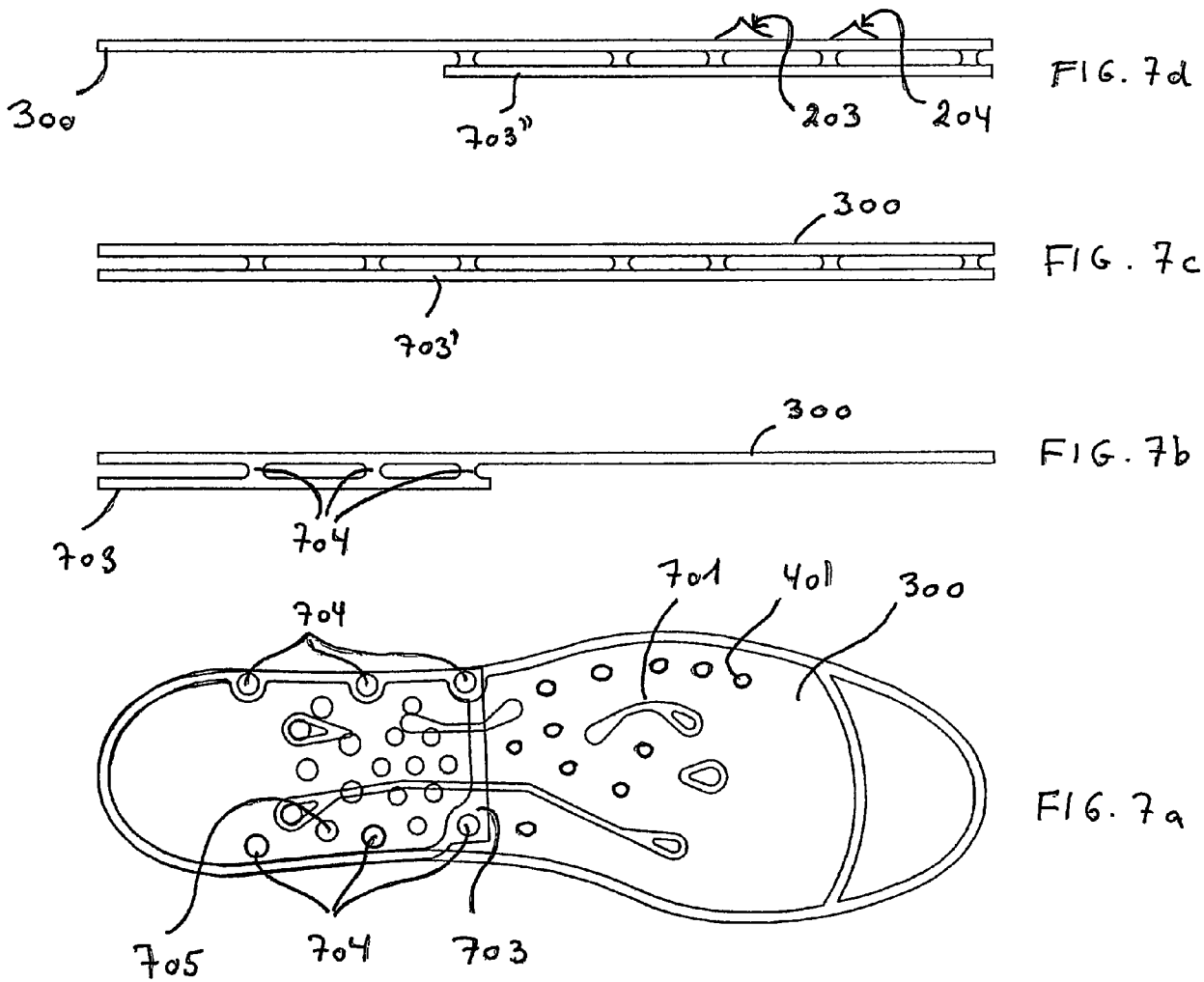

As sketched in FIG. 7*a*, an insole 700 according to the invention may have point-like obstructions 401, for example welding points as explained in connection with FIG. 4 or other types of welding structures 701 as shown on FIG. 7*a* dependent on the flow and flow restriction that is desired. The sketch of the insole in FIG. 7*a* is an overlay image of two fluid chambers, a first chamber 300 of the kind as described in connection with FIG. 4 and a second fluid chamber 703, which is shown in further detail in FIG. 8. The second fluid chamber is connected to the first fluid chamber 300 through connections 704. Those connections 704 may be provided by welding as well.

A second fluid chamber 703' may in principle extend under the whole foot as the first fluid chamber 300, as shown in FIG. 7*c*, however normally, it is preferred that it only extends under a part of the foot, for example the heel, as illustrated in FIG. 7*b* or the forefoot, as illustrated in FIG. 7*d*. The second fluid chamber 703, 703', 703" may be provided above the first fluid chamber 300, but normally, it is preferred to provide the second fluid chamber 703, 703', 703" below the first fluid chamber 300.

Figure 8C:
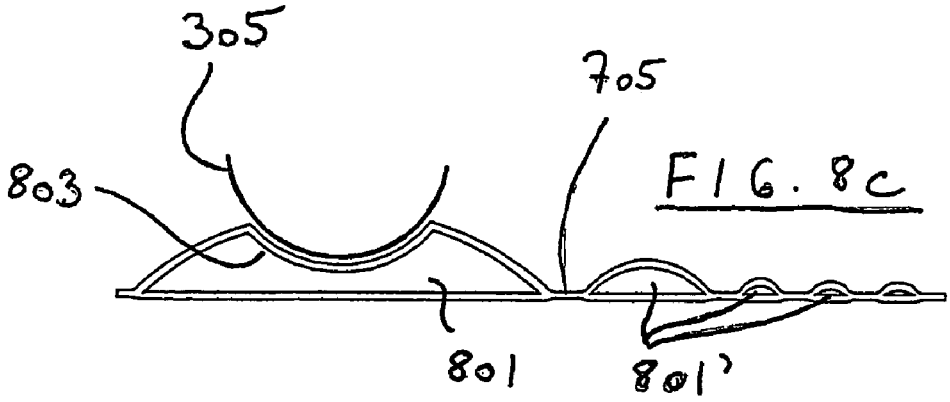
Figure 8B:
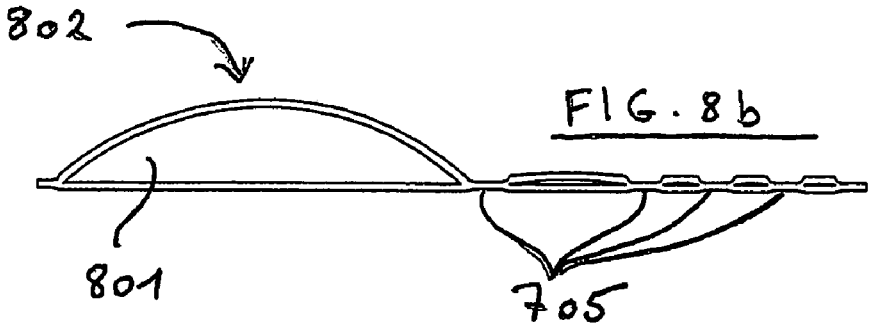
Figure 8A:
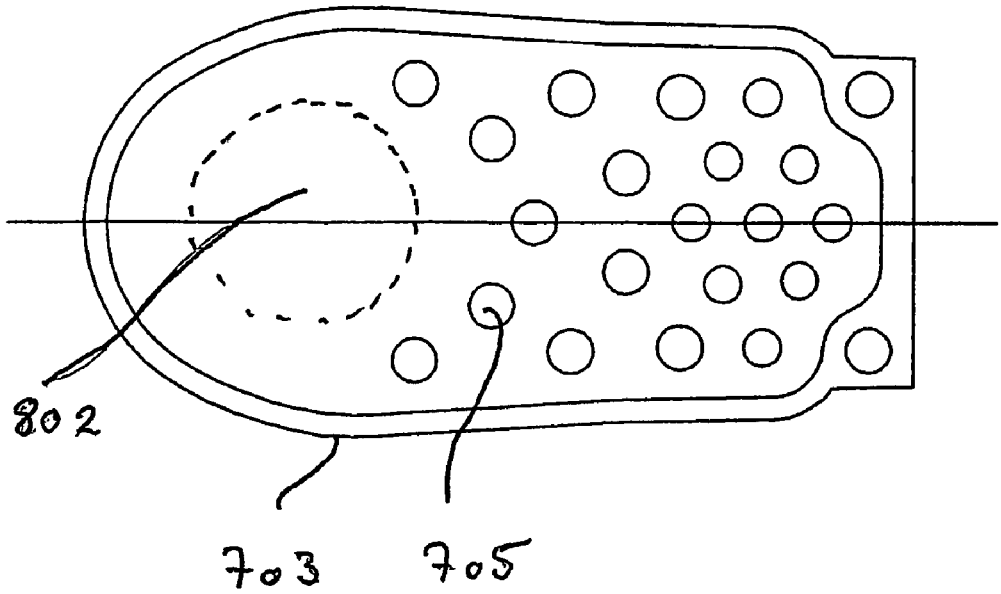

The first 300 and the second fluid chamber 703, 703', 703" may be provided with obstructions 705 that have been obtained in both chambers 300, 703, 703', 703" by welding or each chamber 300, 703, 703', 703" may have its own obstructions 705, 701, 401 in dependence on the desired properties of the first chamber 300 and the properties of the second chamber 703, 703', 703". The obstructions 705 in the second chamber 703 limit the flow of fluid from the heel region 802, which is illustrated in more detail in FIG. 8*b* and FIG. 8*c*, being a cross sectional view of FIG. 8*a* along the shown line. Without suppression from the heel 305, fluid in the volume 801 of the second fluid chamber 703 is primarily present in the heel region 802 as illustrated in FIG. 8*b*. By placing a heel 305 on the second fluid chamber 703, fluid is displaced partly but not completely because only a very restricted volume is available in the remaining volume 801' of the second fluid chamber 803. The resulting area of contact 803 is therefore larger than the area of contact between the ground and the heel 305 if the foot were placed on a flat ground. Therefore, the information provided by the sensing nerves in the heel 305 are stimulated more by such a three dimensional support as shown in FIG. 8*c* than they would on a flat ground. As a consequence, a higher amount of information is submitted to the nerve system with an increase of balance.

Furthermore, a second fluid chamber 703 as the one illustrated in FIG. 8 has the function of shock damping and cushioning. Especially for people suffering from diabetes, an insole with a second fluid chamber 703 as shown is advantageous, because the heel 305 is imbedded in a cushion without welds or joints. The larger area of contact 803, furthermore increases the blood circulation in the heel area 305.

As illustrated in FIG. 7*d*, static elevations may be achieved by attachment, for example gluing, on selected areas on the upper foil of the fluid chamber 300.

An insole according to the invention has a high number of applications. For example, it may be used for changing a walking or running style, for increasing running speed or for training different kind of nerves in the foot in order to stimulate a larger number of nerves than would be stimulated without an insole according to the invention. The latter is useful for an improved balance for top-athletic training, for rehabilitation training and for training of disabled people.

A number of bonus effects are achieved with an insole according to the invention. During walking, the fluid motion back and forth in the fluid filled chamber increases the number of signals from the foot to the brain, as the foot experiences a varying platform for each step—in fact also when standing almost still. An increase in the amount of signals due to variations in the support of the foot results in a more efficient communication from the foot to the brain with a higher awareness of the orientation of the foot on the support. The result is a generally more aware and stable motion of the foot. The fluid motion also increases the fine adjustment by the muscles that regulate the motion of the leg and the foot in order to keep a proper balance. This increased necessary fine adjustment leads to an increased blood circulation counteracting thromboses.

The invention claimed is:

1. Method for providing an insole for footwear for increased sensory stimulation of a foot in the footwear, the method comprising preselecting positions on the foot with nerves at these positions to be stimulated, providing dynamic means for stimulating elevations of said insole at said preselected positions during movement of said foot on said insole, providing said insole with an elastic fluid chamber containing a fluid, the fluid being liquid or gel, the fluid chamber extending from a first region under said foot to a second region under said foot, the second region extending under the foot to said preselected positions, the first region being configured to be subject to suppression under load from the foot for transport of fluid from said first region to said second region during load from said foot on said first region, providing static local elevations on said insole in said second region at said preselected positions.

2. Method according to claim 1, wherein said method comprises determining a pattern of obstructions in the fluid chamber and providing said obstructions in said fluid chamber, said pattern being provided according to predetermined criteria, wherein said predetermined criteria comprises flow of fluid from said first region to said second region during load from the foot on said first region with a promoted increment of height of the insole at said preselected positions for providing dynamic local stimulating elevations.

3. Method according to claim 1, wherein said preselecting positions implies determining the walking profile or running profile of a person.

4. Method according to claim 2, wherein said criteria include flow speed and flow direction.

5. Method according to claim 2, wherein said fluid chamber is provided by joining two foils joined together along an edge area.

6. Method according to claim 5, wherein said obstructions are provided by providing additional joints between said two foils.

7. Method according to claim 6, wherein said providing of additional joints is achieved by welding.

8. Method according to claim 7, wherein said additional joints are provided with different heights for promoting presence of fluid near the higher joints.

9. Method according to claim 8, wherein said providing of additional joints with different heights is achieved by providing various welding pressure.

10. Method according to claim 1, wherein said method comprises providing dynamic elevations at some preselected positions of the foot and providing local static elevations on said insole at further preselected positions on the foot.

11. Method according to claim 1, wherein said fluid chamber extends from the heel to the bale of the foot and wherein the method further comprises providing a second fluid chamber located only under the heel or the bale of the foot.

12. Insole suited for a method according to claim 1, said insole comprising said fluid chamber with fluid between two foils joined along an edge area, wherein said insole comprises means for elevation of said insole at preselected positions under the foot during step movement of said foot on said insole for nerve stimulation.

13. Insole according to claim 12, wherein said means comprises a pattern of additional joints in said fluid chamber between the two foils, wherein said pattern is constructed according to predetermined criteria to promote the flow of fluid from a first region to a second region of the fluid chamber during load from the foot on said first region with an increment of height of the fluid chamber at said preselected positions of the foot for providing dynamic elevations for nerve stimulation.

14. Insole according to claim 13, wherein said insole comprises a further fluid chamber under only the heel part of said foot or only under the bale of the foot.

15. Insole according to claim 14, wherein said fluid chamber of said insole or said further fluid chamber or both of them is provided with a net structure on the upper side for lateral transport of moisture.

16. Insole according to claim 15, wherein the two foils of said fluid chamber of said insole or said further fluid chamber or both of them are provided with fabrics having a tensile strength higher than the tensile strength of the foils, the fabrics being at least partly enclosed in the polymer material of the foils in order to increase the tensile strength of the foil in combination with the fabric for counteracting creep of the foil.

17. Insole according to claim 12, wherein said insole comprises a first, upper part made of polymer foam comprising static elevations at preselected positions of the foot for nerve stimulation during step movement of said foot on said insole and a second, lower part comprising said fluid chamber between two polymer foils.

18. Insole according to claim 17, wherein said second part is constructed to be detachable from said first part.

19. Insole according to claim 17, wherein said first, upper part is provided with a perforation for transport of moisture.

* * * * *